US011261046B2

(12) United States Patent
Perini et al.

(10) Patent No.: US 11,261,046 B2
(45) Date of Patent: Mar. 1, 2022

(54) EQUIPMENT FOR REMOVING PAPER FROM PARENT REELS USED FOR THE PRODUCTION OF LOGS OF PAPER MATERIAL

(71) Applicant: FUTURA S.P.A., Capannori (IT)

(72) Inventors: Fabio Perini, Viareggio (IT); Giovacchino Giurlani, Segromigno in Monte Capannori (IT)

(73) Assignee: FUTURA S.P.A., Capannori (IT)

( * ) Notice: Subject to any disclaimer, the term of this patent is extended or adjusted under 35 U.S.C. 154(b) by 360 days.

(21) Appl. No.: 16/473,028

(22) PCT Filed: Mar. 26, 2018

(86) PCT No.: PCT/IT2018/000045
§ 371 (c)(1),
(2) Date: Jun. 24, 2019

(87) PCT Pub. No.: WO2018/189756
PCT Pub. Date: Oct. 18, 2018

(65) Prior Publication Data

US 2020/0087092 A1 Mar. 19, 2020

(30) Foreign Application Priority Data

Apr. 10, 2017 (IT) ..... 102017000038963

(51) Int. Cl.
*B65H 19/28* (2006.01)
*B65H 19/22* (2006.01)
*B65H 19/26* (2006.01)

(52) U.S. Cl.
CPC ..... *B65H 19/283* (2013.01); *B65H 19/2269* (2013.01); *B65H 19/267* (2013.01);
(Continued)

(58) Field of Classification Search
CPC ..... B65H 19/283; B65H 19/2269; B65H 19/267; B65H 2301/4148;
(Continued)

(56) References Cited

U.S. PATENT DOCUMENTS 3,695,532 A * 10/1972 Lindstaedt ..... B65H 16/021 242/561
4,506,575 A 3/1985 McCay et al.
(Continued)

FOREIGN PATENT DOCUMENTS

EP 0 970 785 A1 1/2000
EP 1 700 805 A2 9/2006
(Continued)

OTHER PUBLICATIONS

International Search Report and Written Opinion of the International Searching Authority dated Jul. 27, 2018 in corresponding International application No. PCT/IT2018/000045; 8 pages.

*Primary Examiner* — William A. Rivera
(74) *Attorney, Agent, or Firm* — Maier & Maier, PLLC

(57) ABSTRACT

Equipment for removing paper from parent reels used for the production of paper logs of paper material, including a support system adapted to support an exhausted parent reel, where the exhausted parent reel includes a tubular core on which residual paper to be removed is wound, and including removal capabilities for removing the residual paper from the core when the exhausted parent reel is placed on the support system. The removal capabilities include a suction cylinder having a horizontal axis onto which the paper is transferred by effect of the contact between the suction cylinder and the exhausted parent reel and by effect of the rotation of the suction cylinder around the horizontal axis.

15 Claims, 11 Drawing Sheets

(52) U.S. Cl.
CPC ..... *B65H 2301/4148* (2013.01); *B65H 2408/235* (2013.01); *B65H 2408/236* (2013.01)

(58) Field of Classification Search
CPC ..... B65H 2408/235; B65H 2408/236; B65H 2301/41552; B65H 19/28; B65H 19/2276; B65H 19/22; B65H 16/06; B65H 19/12; B65H 19/126; B65H 2301/41732; B65H 2301/41346; B65H 75/24; B65H 75/242
See application file for complete search history.

(56) References Cited

U.S. PATENT DOCUMENTS 4,708,300 A * 11/1987 Goetz ..... B65H 19/126 242/551
4,948,060 A * 8/1990 Kurz ..... B65H 19/105 242/552
5,833,168 A 11/1998 Tahata et al.
6,440,268 B1 * 8/2002 Baggot ..... B65H 16/10 162/109
8,016,223 B2 * 9/2011 Pienta ..... B65H 19/126 242/559
2005/0189449 A1 * 9/2005 Bilskie ..... B65H 19/126 242/559.1
2006/0157610 A1 * 7/2006 Rann ..... B65H 19/126 242/560
2009/0114757 A1 * 5/2009 Petri ..... B65H 19/1836 242/554.2
2009/0116948 A1 * 5/2009 Keller ..... B65H 19/12 414/754
2017/0240378 A1 * 8/2017 Perini ..... B65H 75/242

FOREIGN PATENT DOCUMENTS

NL 1 019 633 C2 6/2003
WO 2016/046852 A1 3/2016

* cited by examiner

EQUIPMENT FOR REMOVING PAPER FROM PARENT REELS USED FOR THE PRODUCTION OF LOGS OF PAPER MATERIAL

FIELD

The present invention relates to an equipment for removing the residual paper from parent reels used for the production of logs of paper material.

BACKGROUND

It is known that the production of logs made of paper material, from which are obtained, for example, rolls of toilet paper or rolls of kitchen paper, implies the feeding of a paper web, formed by one or more superimposed layers, on a predetermined path along which various operations are performed before proceeding to the formation of the logs, including a transversal pre-incision of the web to form pre-cut lines which divide it into separable tear-off sheets. The production of the logs normally involves the use of cardboard tubes, commonly called "cores", on whose surface a predetermined amount of glue is distributed to allow the paper web to be bonded to the cores that are introduced into the machine, commonly called "rewinder", that produces the logs. The glue is distributed on the cores when they pass along a corresponding path comprising an end section commonly known as "cradle" due to its concave shape. The formation of the logs also implies the use of winding rollers which impose each core to rotate about its longitudinal axis thus determining the winding of the web on the same core. The process ends when a predetermined number of sheets is wound on the core, with the gluing of a flap of the last sheet on the underlying one of the roll thus formed (so-called "flap gluing" operation). Upon reaching the predetermined number of sheets wound on the core, the last sheet of the log being completed is separated from the first sheet of the next log, for example by a jet of compressed air directed towards a corresponding pre-cutting line. At this point, the log is downloaded from the rewinder. EP1700805 discloses a rewinder working according to the operating scheme disclosed above. The logs thus produced are then conveyed to a buffer magazine that supplies one or more cutting-off machines by means of which a transverse cutting of the logs is carried out to obtain the rolls in the desired size.

SUMMARY

It is also known that the paper destined to feed a rewinder is supplied by large diameter reels, normally called parent reels, placed on suitable unwinders positioned upstream of the rewinder itself. Each parent reel is formed of a pre-established amount of paper wound on a tubular core. When a parent reel is almost exhausted, the paper is taken from another reel placed on a second unwinder so as not to interrupt the production of the logs, after which the first reel is removed from its seat and in its place is loaded another and so on. The exhausted reel always has a certain amount of residual paper on its core and, since the latter must be re-used, the residual paper must be removed. For this purpose, the cores of the exhausted reels are loaded onto forklifts and transported to a cleaning station where an operator, possibly using a special equipment, provides for the removal of the residual paper. U.S. Pat. No. 4,506,575 discloses an apparatus for removing the residual paper from cores of paper rolls destined to be reused.

The main object of the present invention is to provide an equipment allowing an improvement of the cleaning operations on the cores of parent reels.

This result has been achieved, in accordance with the present invention, by means of a machine and a process having the characteristics as disclosed herein.

Thanks to the present invention it is possible to improve the cleaning operations on the cores of parent reels by introducing automatic control modes of the same operations which make the process safer and more efficient.

BRIEF DESCRIPTION OF THE DRAWINGS

These and further advantages and characteristics of the present invention will be more evident to any person skilled in the art, thanks to the following description and to the attached drawings, provided as an example but not to be considered in a limiting sense, in which.

DETAILED DESCRIPTION

Figure 1A:
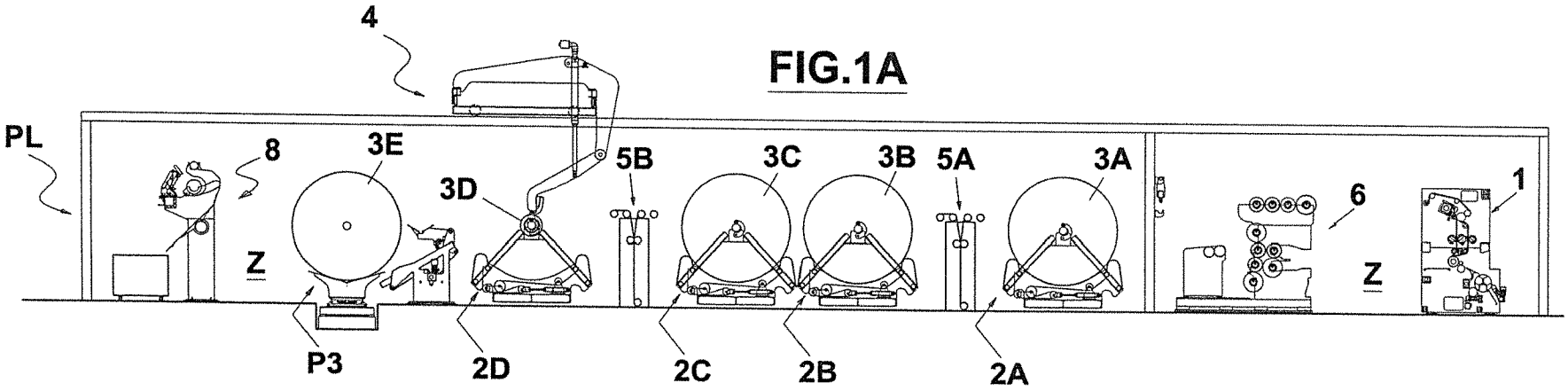
FIG. 1A shows a schematic side view of a plant using an apparatus according to the present invention.
Figure 1B:
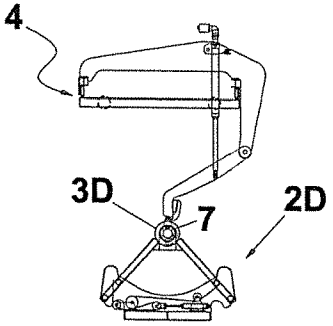
FIG. 1B is an enlarged detail of FIG. 1A.

Reduced to its essential structure and with reference to the figures of the attached drawings, a plant for the production of logs of paper material in which, for example, an equipment (8) according to the present invention can be used, comprises a rewinder (1) which produces logs, and a plurality of unwinders (2A, 2B, 2C, 2D). Each of said unwinders is suitable for supporting a corresponding parent reel (3A, 3B, 3C, 3D) from which the paper web is unwound for feeding the rewinder (1). The plant also includes a bridge crane (4). Moreover, the plant (PL) can be provided with several bonding units (5A, 5B) intended to join the tail of the web fed by a parent reel in the phase of exhaustion with the head of the web fed by another parent reel mounted, on a respective unwinder. The plant (PL) can also be provided with a unit (6) for gluing and embossing the webs placed upstream of the rewinding machine (1) with respect to the direction of the web fed by the parent reels.

Said parent reels are constituted by a paper web wound around a tubular support core (30).

The number of unwinders, the presence and the number of the mating units, and the possible presence of the gluing and embossing unit are not to be considered in a limiting sense for the purposes of the present description, but only for illustrative purposes.

The operating units of the plant (PL), i.e. the rewinder, the unwinders, the bonding units and the gluing and embossing unit are installed on an area (Z) above which the bridge crane (4) operates which, therefore, is able to serve each of these units.

Inside said area (Z) there is also a support unit for the parent reels in a parking point (P3) where the parent reels (3E) can be temporarily positioned, waiting to be placed on the unwinders.

A plant (PL) of the type indicated above is disclosed, for example, in WO2016/046852 to which reference is made for a more detailed description. The structure and operation of the individual operating units (1, 2A-2D, 3A-3D, 4, 5, 6) of the plant (PL) are known per se. In particular, the bridge crane (4) is of the type comprising two arms (40) each of which is adapted to engage and move an expandable pin (7) that can be inserted in any core (30) of the parent reels (3A, 3B, 3C, 3D). An expandable pin (7) suitable for carrying out this function is disclosed for example in WO2016/046852.

The plant also comprises an equipment (8) designed to remove the residual paper from the cores (30) of the exhausted parent reels. As mentioned in the introduction, in fact, there is a need to perform this operation in order to reuse the cores (30) of the parent reels.

Preferably, said equipment (8) is positioned at a predetermined point within the area (Z) served by the bridge crane (4). In this way, as further described in the following, the bridge crane (4) can be used to move the cores (30) of the exhausted parent reels even while the logs are being produced.

Figure 3A:
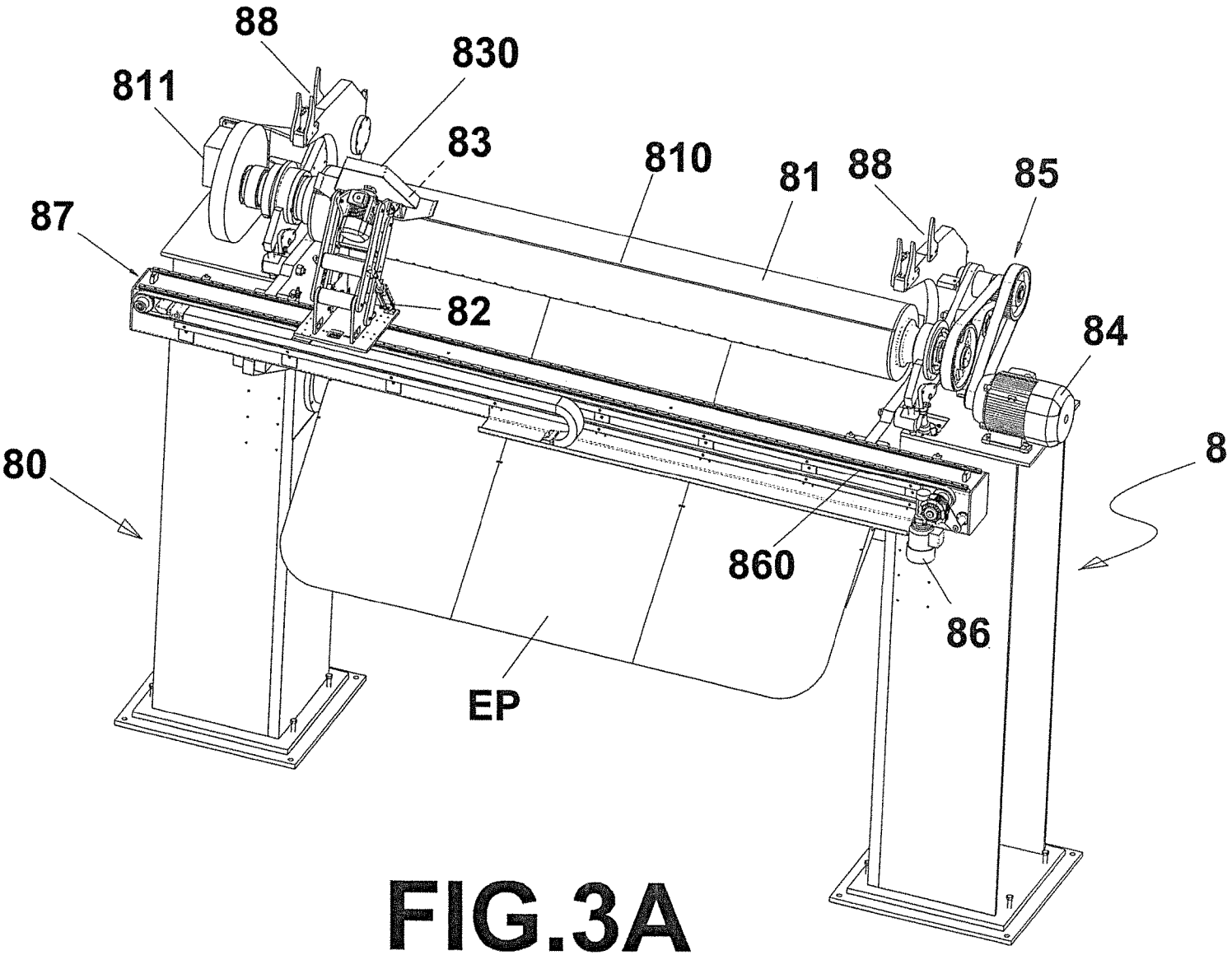
FIG. 3A schematically represents an equipment (8) for removing the residual paper from the cores of exhausted parent reels according to the present invention.
Figure 3C:
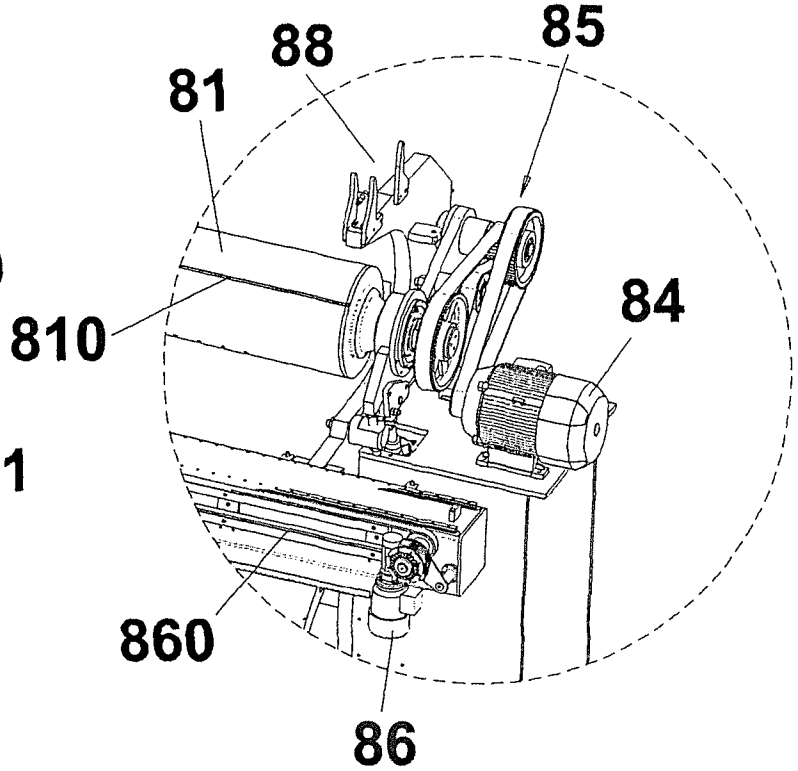
FIG. 3C is an enlarged detail of FIG. 3A.
Figure 3B:
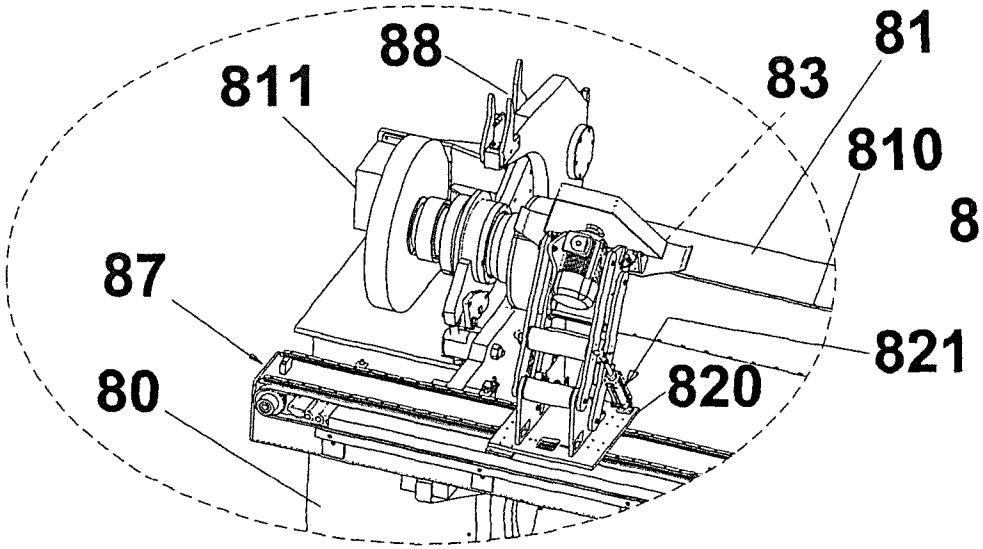
FIG. 3B is an enlarged detail of FIG. 3A.

With reference to the example shown in FIGS. 3A-3C, an equipment (8) according to the invention comprises a fixed bearing structure (80) on which are mounted: a suction cylinder (81) with a horizontal axis, a carriage (82) equipped with a blade (83), an actuator (84), for example an electric motor, that determines the rotation of the suction cylinder (81) around its axis by means of a belt and pulley connection (85), an electric motor (86) which, by means of a respective belts connection (860), determines the movement of the carriage (82) along a guide (87) parallel to the axis of the suction cylinder (81), and a superstructure with two seats (88) each of which is shaped to accommodate a corresponding expandable pin (7). Said blade (83) is covered by a respective casing (830) and is, for example, a circular blade driven by a corresponding electric motor (831) supported by said carriage (82). The cylinder (81) is connected to an aspirator (811) which produces a depression inside it. FIG. 8 illustrates a portion of the cylinder (81), showing the internal cavity (81C) and the radial holes (81H) through which the suction produced by the aspirator (811) is transmitted to the outside. Furthermore, each end of the cylinder (81) is supported by a respective arm (812). The arms (812) allow to keep the suction cylinder (81) in a lowered position and in a raised position as further described below. Each arm (812) has a rear side hinged on the structure (80) with a hinge axis (801) parallel to the longitudinal axis of the suction cylinder (81). Moreover, each arm (812) has a front side with an appendix (813) that, in a lowered cylinder (81) position, rests on an abutment (800) of the structure (80). In a predetermined position between its rear and front sides, each arm (812) has a cradle seat (817) in which a corresponding end of the cylinder (81) is constrained. Each arm (812) is connected to a respective actuator (814) allowing it to rotate about the hinge axis (801) to raise and lower the cylinder (81). With reference to the example shown in the drawings, each actuator (814) is connected to a lower appendix (815) of the respective arm and, on the opposite side (816), is constrained to the structure (80). When the pins (7), that support the core of the exhausted parent reel (3D) to be cleaned, are brought by the bridge crane into the seats (88) on the structure (80), as shown in FIG. 7A, the cleaning cycle can be started: the suction cylinder (81) is lifted and brought into contact with the reel (3D) by the corresponding pneumatic actuators (814) as schematically shown in FIG. 7B; in the meantime, the aspirator (811) is activated.

Figure 7B:
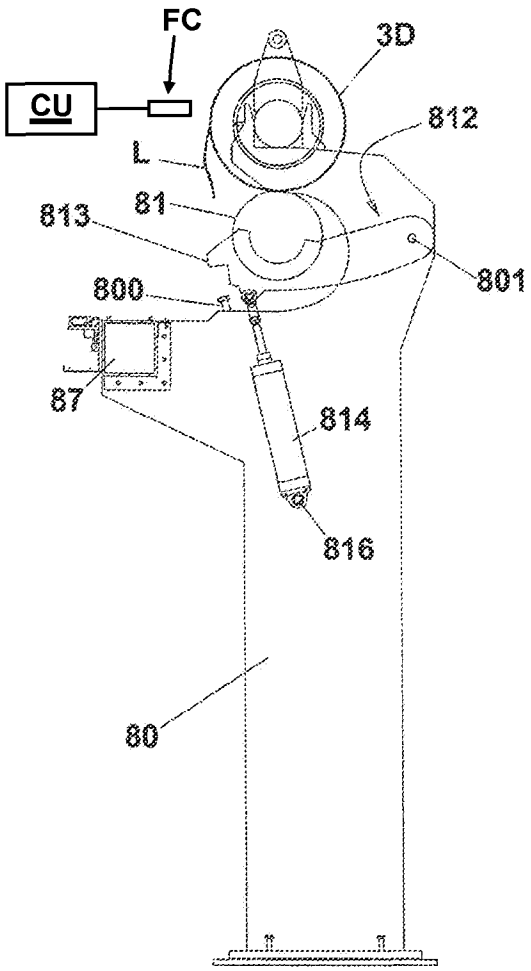
FIG. 7B schematically represents a sequence of operating steps concerning an apparatus according to the invention.
Figure 7A:
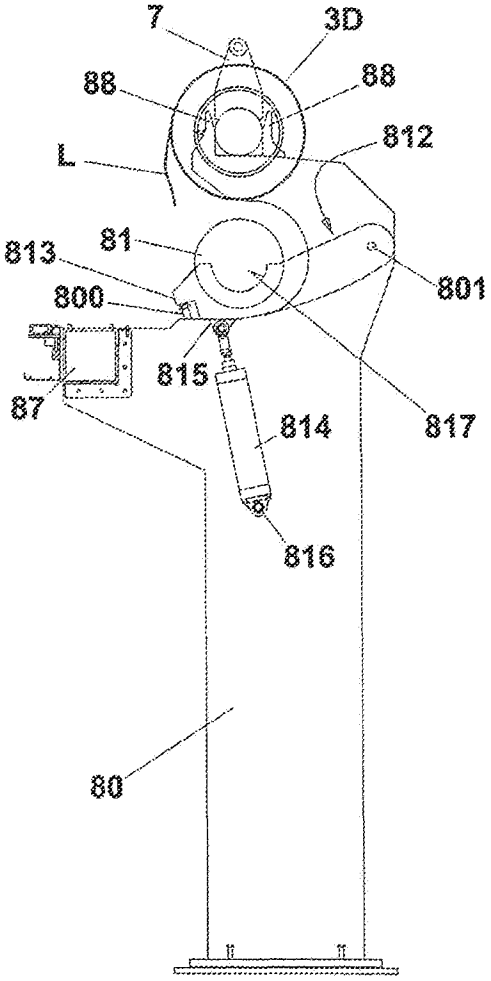
FIG. 7A schematically represents a sequence of operating steps concerning an apparatus according to the invention.
Figure 7D:
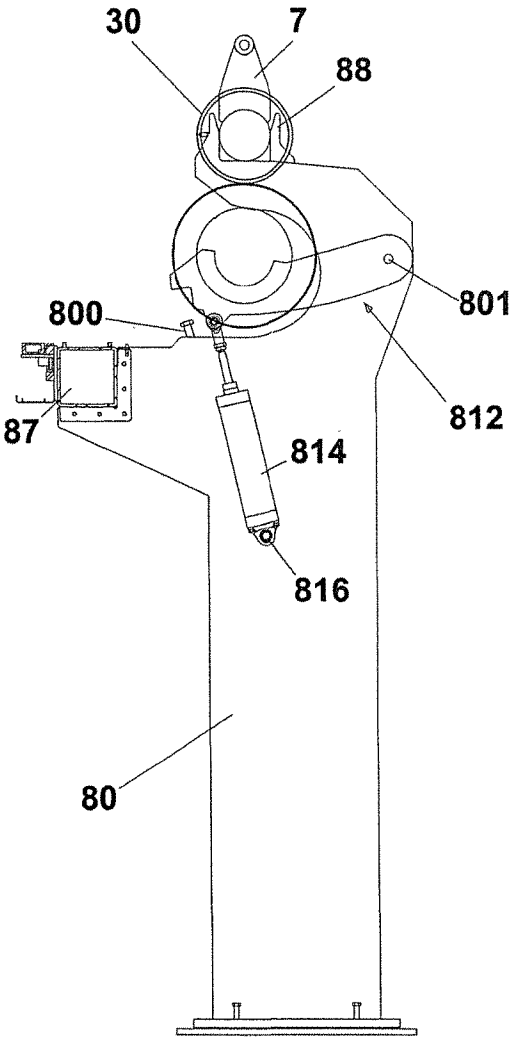
FIG. 7D schematically represents a sequence of operating steps concerning an apparatus according to the invention.
Figure 7C:
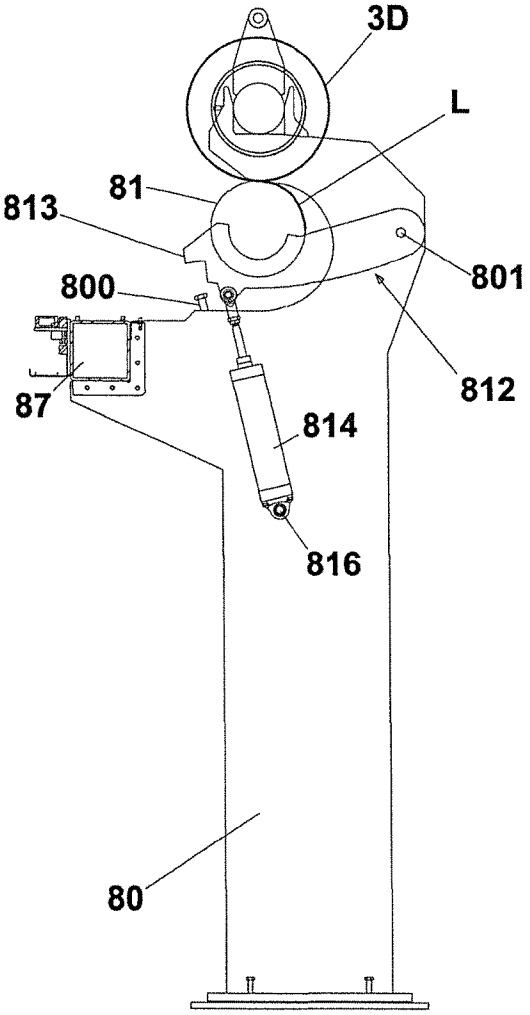
FIG. 7C schematically represents a sequence of operating steps concerning an apparatus according to the invention.
Figure 8:
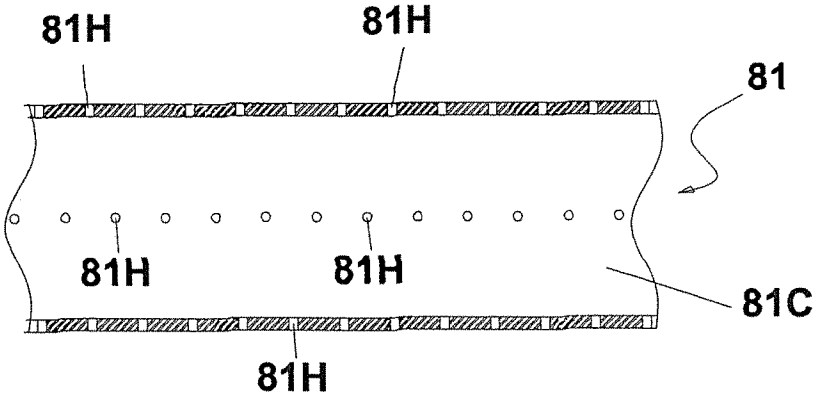
FIG. 8 shows a longitudinal section view of a portion of the suction cylinder (81) that, in particular, shows the internal cavity and the radial holes of the suction cylinder.

FIGS. 7A and 7B show the flap (L) of the residual paper protruding from the reel (3D). Depending on the orientation of the unwinder from which the reel has been removed, the suction cylinder (81) is rotated clockwise or counterclockwise by the motor (84), thus rotating the reel (3D) by friction and wrapping on it the paper that unwinds from the reel. FIG. 7C shows the aforementioned flap (L) in a position adhering to the suction cylinder (81) due to the rotation of the latter and the suction exerted. This rotation continues until the core is clean (FIG. 7D). In practice, the suction cylinder (81) is rotated in a direction suitable for unwinding the paper from the reel according to the direction of winding of the same paper on the reel thus acting as a rewinding cylinder.

Figure 7E:
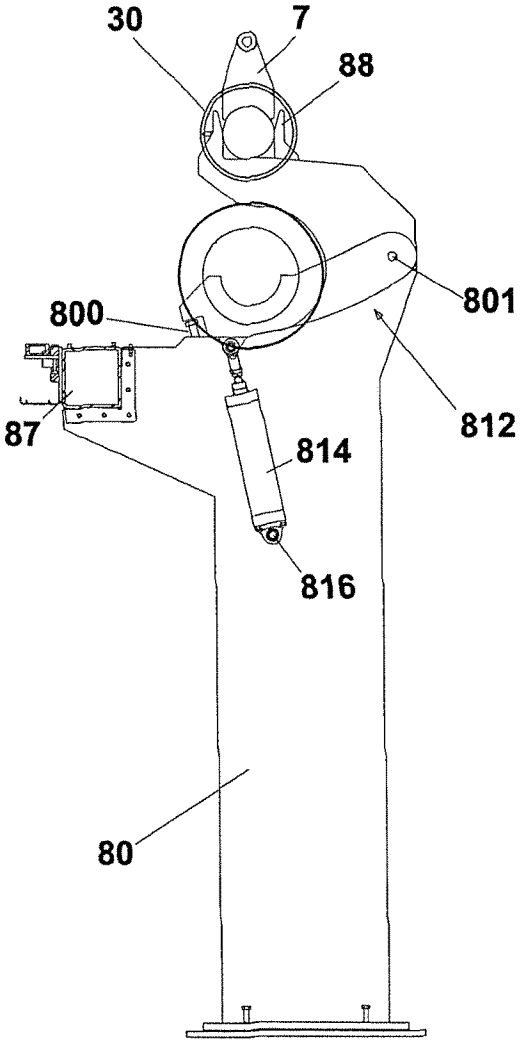
FIG. 7E schematically represents a sequence of operating steps concerning an apparatus according to the invention.

A detection means, for example an optical detection means such as a photocell FC, detects the diameter of the reel (3D) during the cleaning phase in order to identify the time when there is no more paper on the reel. This photocell FC transmits the detection to a control unit CU that manages the suction, rotation and positioning of the suction cylinder. At this point, the suction cylinder (81) is returned to its lowered initial position by the respective actuators, as shown in FIG. 7E, and rotates until a slot (810) provided on its outer surface is aligned with the blade (83). Then begins the cutting phase: the carriage (82) brings the blade (83) in contact with the paper wound on the surface of the cylinder (81) and, with successive passes, removes the paper from the cylinder. The cutting action is particularly effective because it occurs thanks to the introduction of the blade (83) into the slot (810) so as to pass through all the layers of paper present on the cylinder because the slot (810) is more internal than the surface of the cylinder on which the paper is wrapped. While the cutting unit (82, 83) removes the paper from the cylinder (81), the bridge crane (4) can continue the cycle of change of the parent reels in the plant, thus determining a drastic reduction of dead times. In FIGS. 7A-7E the paper subject to the transfer, i.e. the paper removed from the reel (3D) and transferred onto the cylinder (81), is represented with thicker lines. In the aforesaid slot (810) a rubber insert, not visible in the drawings, can advantageously be positioned, which acts as an elastic contrast surface for the blade during removal of the paper from the cylinder (81).

In place of the photocell, for example, a mechanical probe can be used.

For example, the carriage (82) comprises a base (820) constrained to the belt (860) driven by the motor (86) which determines the movement of the carriage along the direction defined by the guide (87). On said base (820) two pneumatic actuators (821) are positioned which, by means of a group of articulated levers (822), are connected to a plate (823) supporting the motor (831) driving the blade (83). In practice, the actuators (821) allow to bring the blade (83) near the cylinder (81) and, vice versa, to move it away from the cylinder. The motor (86) determines the translation of the carriage (82) parallel to the suction cylinder (81) and the actuators (821) move the blade (83) to and from the cylinder (81). As previously stated, the blade (83) removes the paper from the cylinder (81) in several passes, with the carriage (82) being moved alternately along the guide (87).

The drawings show an inclined plane (EP) from which the removed paper exits. The paper removed from the core is collected by gravity in an underlying basket which in FIGS. 2A-2E and 4A is indicated by the reference "CE" and which can be a wheeled basket.

Figure 2A:
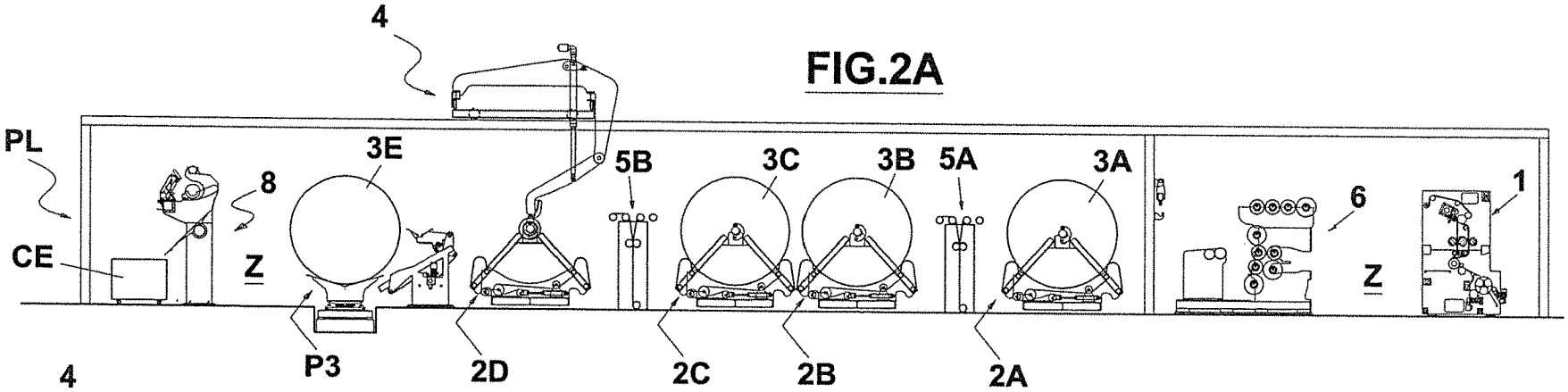
FIG. 2A schematically represents a possible mode of use of the plant shown in FIG. 1.

In accordance with a possible example of use of a plant provided with an equipment according to the present invention and with reference to FIGS. 2A-2E of the attached drawings (in which FIG. 2A is identical to FIG. 1A but is repeated for better illustrating a possible sequence of operations related to the use of the equipment 8), when a parent reel (3D) is exhausted, the bridge crane (4) is brought in correspondence with the respective unwinder (2D). At this point, the bridge crane (4) engages each of the pins (7) present at the ends of the core (30) of the exhausted reel as shown in FIG. 2A.

Figure 2B:
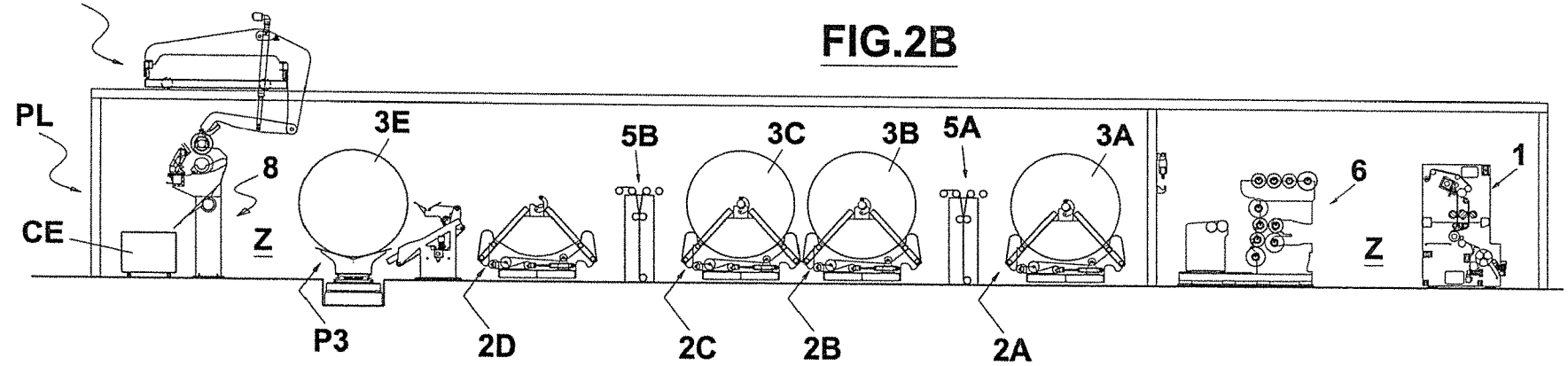
FIG. 2B schematically represents a possible mode of use of the plant shown in FIG. 1.
Figure 2C:
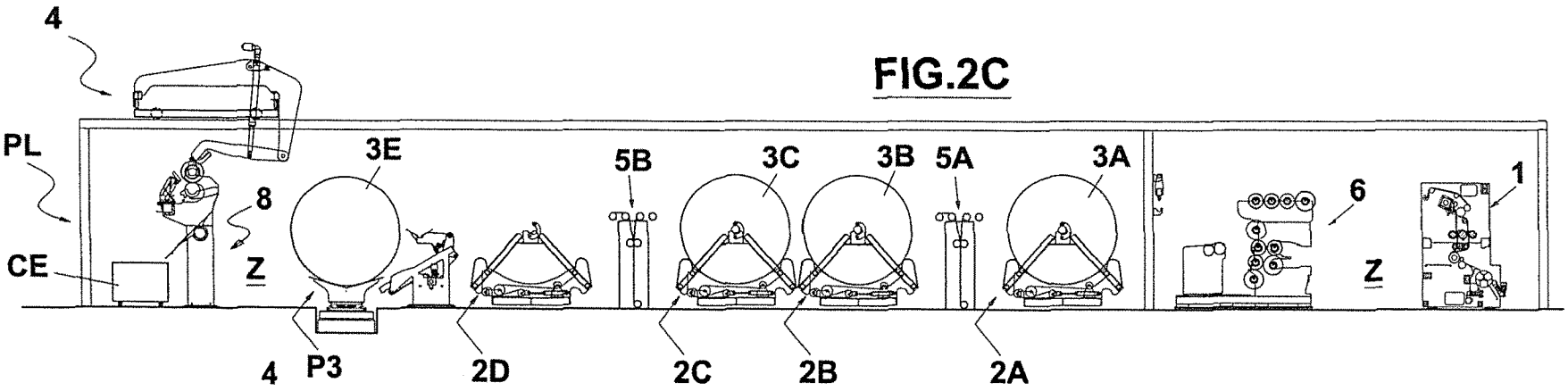
FIG. 2C schematically represents a possible mode of use of the plant shown in FIG. 1.
Figure 2D:
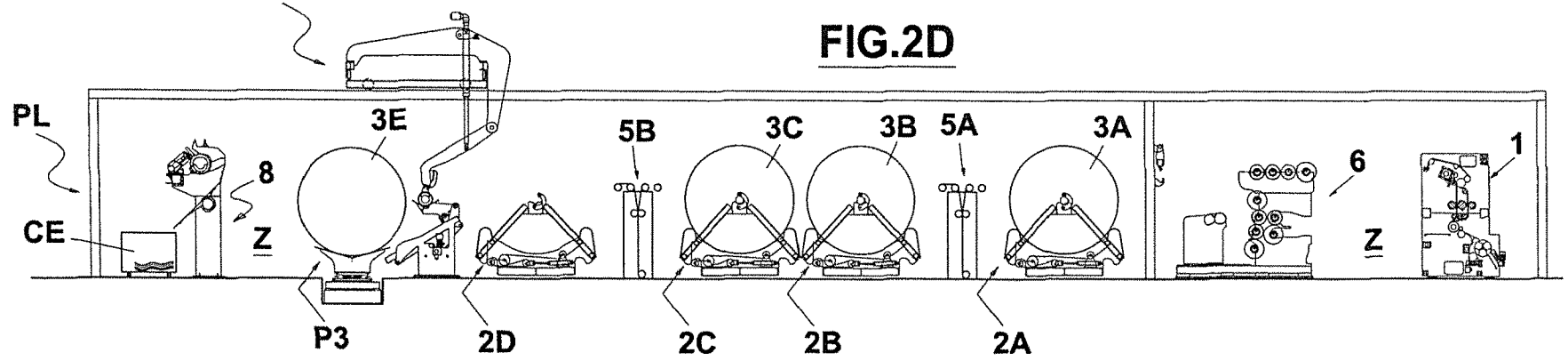
FIG. 2D schematically represents a possible mode of use of the plant shown in FIG. 1.
Figure 2E:
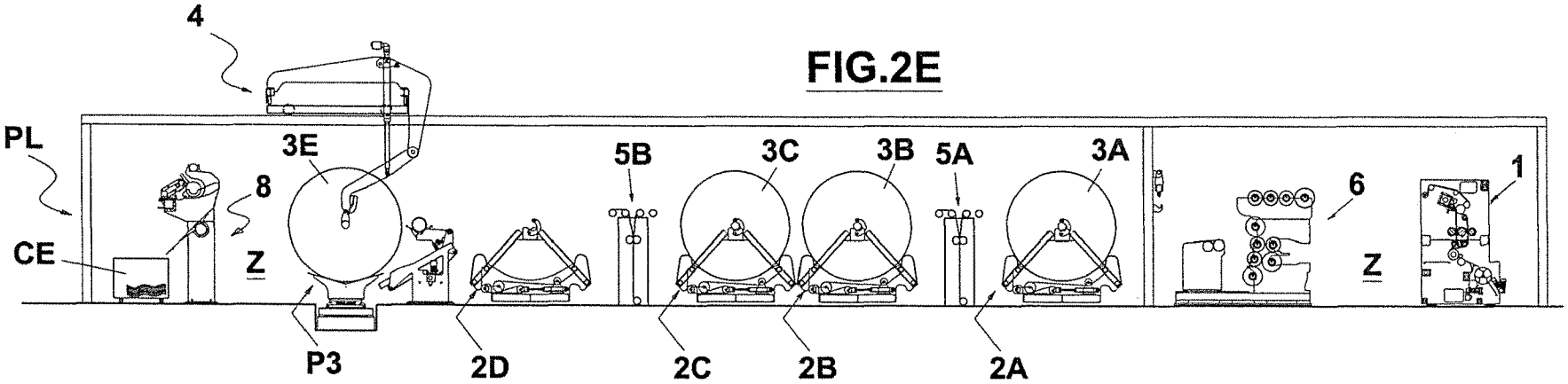
FIG. 2E schematically represents a possible mode of use of the plant shown in FIG. 1.
Figure 5:
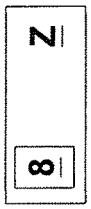
FIG. 5 is a schematic representation relating to a possible location of the equipment (8) in a plant according to the present invention.

In this way, the bridge crane (4) can lift the reel, removing it from the unwinder, and bring it to the equipment (8), as shown in FIG. 2B. Here an operator starts the cycle of removal of the residual paper from the exhausted reel (3D) while the latter is still constrained to the bridge crane (4) through the pins (7) inserted in its core. Once the cleaning operation is completed, the bridge crane (4) carries the cleaned core (3 OR) to a parking point (9) and frees it by extracting the pins (7) from it, as shown in FIG. 2C and FIG. 2D. Subsequently, as shown in FIG. 2E, the bridge crane (4), using the same pins (7), picks up a new parent reel (3E) from the parking point (P3) and then transfers it to the free unwinder (2D). In this example, the bridge crane (4) is busy for as long as the core (30) subjected to cleaning is kept on the equipment (8). Alternatively, the bridge crane (4) can release the core (30) to be cleaned on the aforesaid seats (88) of the equipment (8) without extracting the pins (7) from the core (30). In this case, the pins (7) will remain constrained to the core (30) and will be held by suitable jaws (89) arranged at the seats (88) and controlled by respective actuators (11) which are connected to the jaws by means of link levers (890). In this case, the bridge crane (4), before engaging the new reel (3E) at the waiting point (P3), will pick up two pins at a predetermined pins parking area.

Figure 4B:
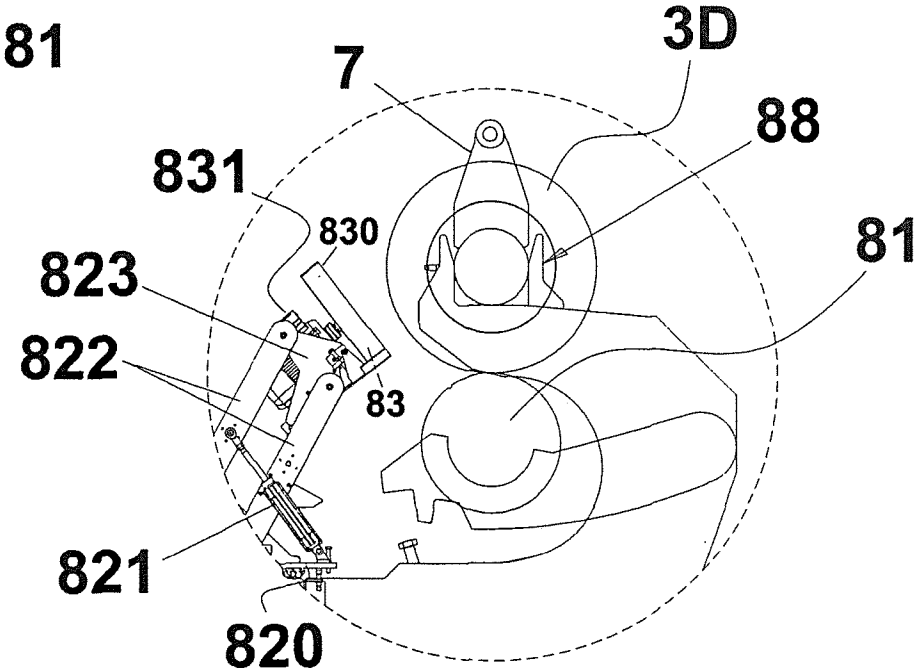
FIG. 4B represents an enlarged detail of FIG. 4A.
Figure 4A:
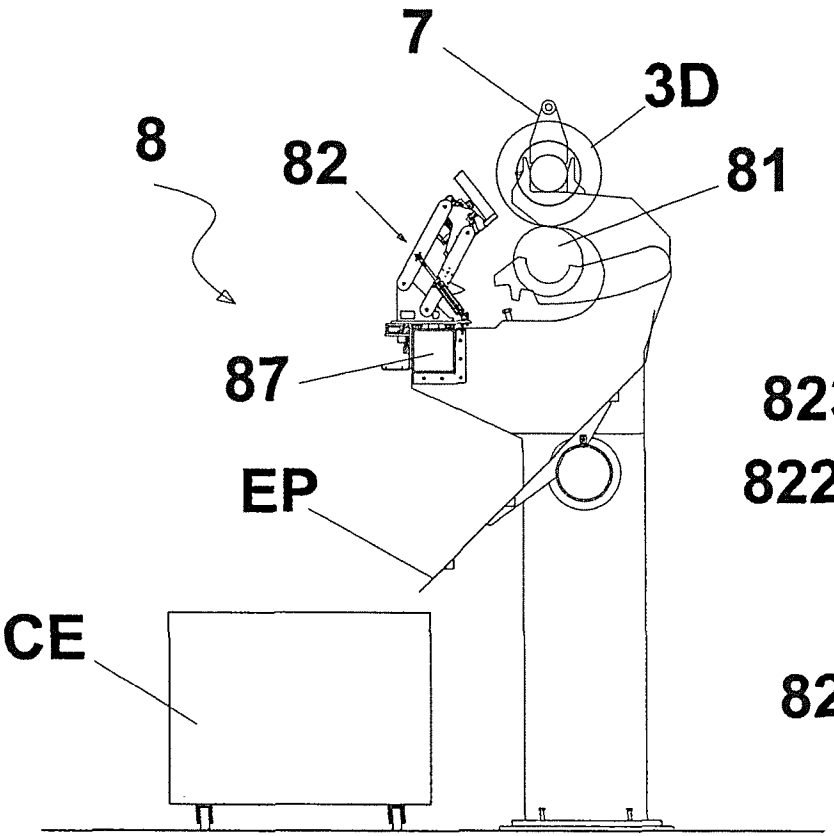
FIG. 4A is a schematic side view of the equipment shown in FIG. 3A in an operating configuration in which some elements are omitted to better highlight others.

FIG. 4A and FIG. 4B show the suction cylinder (81) in contact with the exhausted reel (3D) supported by the supports (88). When the suction in the cylinder (81) is activated and the cylinder (81) is rotated about its axis, the contact between the exhausted reel (3*d*) and the cylinder (81) determines the transfer of the paper from the core (30) of the exhausted coil (3D) to the cylinder (81) which, therefore, as said previously, acts as a rewinding cylinder and collects on its outer surface the paper removed from the core (30).

Figure 6B:
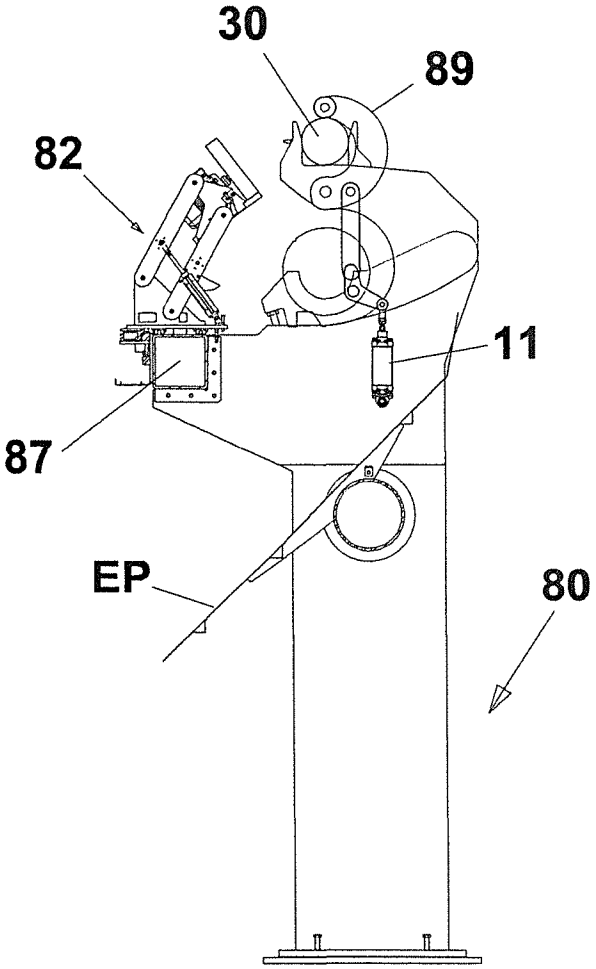
FIG. 6B schematically represents a further configuration of the equipment (8)
Figure 6A:
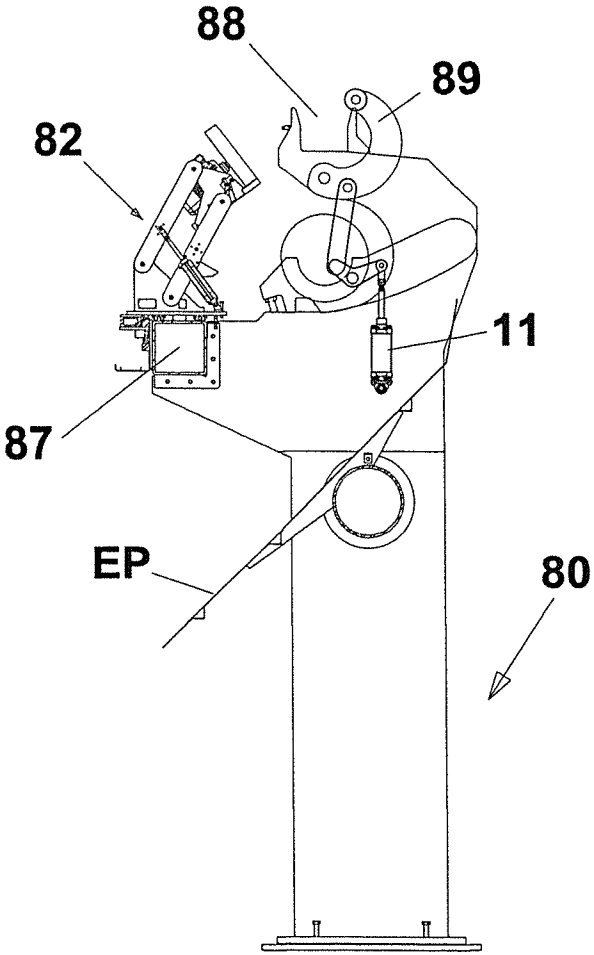
FIG. 6A schematically represents a further configuration of the equipment (8)

FIG. 6A shows the equipment (8) in the waiting configuration, waiting for an exhausted parent reel to be cleaned, with the suction cylinder (81) in the lowered waiting position. FIG. 6B shows the same equipment (8) at the end of a cleaning cycle, with a core (30) cleaned and with the suction cylinder (81) brought back to a position spaced from the core. The position of the suction cylinder (81) shown in FIG. 6B also corresponds to the position it assumes when, once its rotation has been stopped, the blade carried by the carriage (82) intervenes.

The handling of the cores of the exhausted coils and the loading of the new coils take place in parallel to the production of the logs that is not interrupted.

The provision of the equipment (8) at a point inside the area (Z) served by the bridge crane (4) offers the possibility to use the latter more efficiently and to increase the automation level of the plant itself. At the same time, there is a more rational use of the available spaces.

The cores of the reels subjected to the aforementioned cleaning operation can be placed in an accumulation station by the bridge crane.

From the foregoing description it is evident that the suction cylinder (81) is used to remove the residual paper from the exhausted parent reel (3D). In other words, the suction cylinder (81) collects on itself the paper removed from the exhausted parent reel (3D), so that the core (30) of the latter can be started for reuse even immediately after removal of the paper. The definitive elimination of the paper removed from the exhausted reel is determined by the blade (83) which acts, as previously said, on the suction cylinder (81).

It is therefore an object of the present invention an equipment for removing paper from the cores of parent reels used for the production of logs made of paper material, comprising a support system (88) adapted to support an exhausted parent reel (3D), wherein the exhausted parent reel (3D) comprises a tubular core (30) on which residual paper to be removed is wound, and comprising removal means for removing the residual paper from said core (30) when the exhausted parent reel (3D) is placed on said support system (88), wherein said removal means comprise:

- a base structure (80) on which, along a horizontal axis, is mounted a suction cylinder (81) having an outer surface perforated and communicating with an internal cavity (81C) that, in turn, is connected to a suction unit (811) adapted to produce a depression inside the cylinder (81), whereby said depression is transmitted to the outer surface of the cylinder (81);
- an actuator (84) that determines the rotation of the cylinder (81) around said axis with a predetermined angular speed and direction of rotation, wherein said support system (88) is adapted to support the exhausted parent reel (3D) parallel to the said cylinder (81);

and wherein the following means are provided

- means for adjusting the distance between said support system (88) and said cylinder (81), to allow contact between the cylinder (81) and the exhausted parent reel (3D) in a phase of removal of the residual paper;
- detection means for detecting the instantaneous diameter of the exhausted parent reel placed on the support system (88);

a control unit connected to said detection means and adapted to control the actuator (84) which determines the rotation of the cylinder (81) as a function of the instantaneous diameter of the exhausted parent reel (3D) detected by the detection means, said control unit being programmed to stop the rotation of the cylinder (81) when the instantaneous diameter of the exhausted parent reel (3D) reaches a predetermined minimum value;

and wherein said rotation of the cylinder (81) and the depression on the outer surface of the same cylinder (81) determine the rotation of the exhausted parent reel (3D) and the transfer of the residual paper from the exhausted parent reel (3D) to the cylinder (81) when the latter and the exhausted parent reel (3D) come into contact.

According to particular aspects of the invention as disclosed above, the support system (80) is fixed and said cylinder (81) is connected to respective actuators that place it in contact with the exhausted reel in a start-up phase of a cycle of removal of the residual paper from the exhausted parent reel and away from the latter when said minimum diameter is reached.

the cylinder (81) is provided with a longitudinal cavity (810) on its outer surface.

to the base structure (80) is associated a carriage (82) that is moved by a respective actuator (86) along a guide (87) parallel to the axis of the cylinder (81) and carries a blade (83) adapted to be inserted in said longitudinal cavity (810).

said control unit is programmed to actuate the carriage (82) when the cylinder (81) is not in contact with the exhausted parent reel (3D).

said control unit drives the rotation of the cylinder (81) such that the longitudinal cavity (810) is in correspondence of the blade (83) when the cylinder (81) is not in contact with the exhausted parent reel (3D).

locking means (89) for locking the exhausted parent reel (3D) are associated with the support system (88).

said locking means act on pins (7) inserted in the exhausted parent reel, the equipment is located in a plant comprising: a rewinder (1) adapted to produce paper logs using a paper web; a predetermined number of unwinders (2A, 2B, 2C, 2D) each of which is adapted to support a corresponding parent reel (3A, 3B, 3C, 3D) from which the paper web supplied to the rewinder (1) is unwound; a bridge crane (4) disposed and acting on an area (Z) inside which are placed the rewinder (1) and the unwinders (2A, 2B, 2C, 2D); wherein said cleaning equipment (8) is inside the area (Z) served by the bridge crane (4) so that the latter can be used for moving said cores (30) to and from the cleaning equipment (8).

said detection means are optical detection means, or said detection means are mechanical detection means.

In practice, the details may in any case vary according to the individual elements described and illustrated, without thereby departing from the scope of the adopted solution idea and therefore remaining within the limits of the protection afforded by the present patent.

The invention claimed is:

1. Equipment for removing paper from parent reels used for the production of paper logs of paper material, comprising:

a support system adapted to support an exhausted parent reel, wherein the exhausted parent reel comprises a tubular core on which residual paper to be removed is wound, and comprising removal means for removing the residual paper from said core when the exhausted parent reel is placed on said support system, and said removal means comprises:

a base structure on which, along a horizontal axis, is mounted a suction cylinder having an outer surface perforated and communicating with an internal cavity that, in turn, is connected to a suction unit adapted to produce a depression inside the suction cylinder, whereby said depression is transmitted to the outer surface of the suction cylinder;

an actuator that determines the rotation of the suction cylinder around said axis with a predetermined angular speed and direction of rotation, and said support system is adapted to support the exhausted parent reel parallel to the suction cylinder;

the equipment further comprising:

means for adjusting the distance between said support system and said cylinder, to allow contact between the suction cylinder and the exhausted parent reel in a phase of removal of the residual paper;

detection means for detecting the instantaneous diameter of the exhausted parent reel placed on the support system;

a control unit connected to said detection means and adapted to control the actuator which determines the rotation of the suction cylinder as a function of the instantaneous diameter of the exhausted parent reel detected by the detection means, said control unit being programmed to stop the rotation of the suction cylinder when the instantaneous diameter of the exhausted parent reel reaches a predetermined minimum value; and said rotation of the suction cylinder and the depression on the outer surface of the suction cylinder determine the rotation of the exhausted parent reel and the transfer of the residual paper from the exhausted parent reel to the suction cylinder when the suction cylinder and the exhausted parent reel come into contact.

2. Equipment according to claim 1, wherein said suction cylinder is connected to respective actuators that place the suction cylinder in contact with the exhausted reel in a start-up phase of a cycle of removal of the residual paper from the exhausted parent reel and away from the exhausted parent reel when said minimum diameter is reached.

3. Equipment according to claim 1, wherein said suction cylinder is provided with a longitudinal cavity on its outer surface, the equipment comprising a carriage that is moved by a respective actuator along a guide parallel to the axis of the suction cylinder and the carriage carrying a blade adapted to be inserted in said longitudinal cavity.

4. Equipment according to claim 3, wherein said control unit is programmed to actuate the carriage when the suction cylinder is not in contact with the exhausted parent reel.

5. Equipment according to claim 1, wherein said control unit drives the positioning of the cylinder with said longitudinal cavity in correspondence of said blade when the cylinder is not in contact with the exhausted parent reel.

6. Equipment according to claim 1, comprising means for locking the exhausted parent reel associated with said support unit.

7. Equipment according to claim 6, wherein said locking means act on pins inserted in the exhausted parent reel.

8. Equipment according to claim 1, located in a plant comprising: a rewinder adapted to produce paper logs using a paper web; a predetermined number of unwinders each of which is adapted to support a corresponding parent reel from which the paper web supplied to the rewinder is unwound;

a bridge crane disposed and acting on an area inside which are placed the rewinder and the unwinders; wherein said equipment is inside the area served by the bridge crane so that the bridge crane can be used for moving said cores to and from the cleaning equipment.

9. Equipment according to claim 1, wherein said detection means are optical detection means.

10. Process for removing paper from parent reels used for the production of paper logs of paper material, comprising:

providing a support system adapted to support an exhausted parent reel, wherein the exhausted parent reel comprises a tubular core on which residual paper to be removed is wound;

providing removal means for removing the residual paper from said core when the exhausted parent reel is placed on said support system, and said removal means comprising:

a base structure on which, along a horizontal axis, is mounted a suction cylinder having an outer surface perforated and communicating with an internal cavity that, in turn, is connected to a suction unit adapted to produce a depression inside the suction cylinder, whereby said depression is transmitted to the outer surface of the suction cylinder; and an actuator that determines the rotation of the suction cylinder around said axis with a predetermined angular speed and direction of rotation, and wherein said support system is adapted to support the exhausted parent reel parallel to the said suction cylinder;

the process further comprising:

adjusting the distance between said support system and said suction cylinder, to allow contact between the suction cylinder and the exhausted parent reel in a phase of removal of the residual paper;

detecting the instantaneous diameter of the exhausted parent reel placed on the support system; and controlling the actuator which determines the rotation of the suction cylinder as a function of the instantaneous diameter of the exhausted parent reel, and stopping the rotation of the suction cylinder when the instantaneous diameter of the exhausted parent reel reaches a predetermined minimum value;

wherein said rotation of the suction cylinder and the depression on the outer surface of the suction cylinder determine the rotation of the exhausted parent reel and the transfer of the residual paper from the exhausted parent reel to the suction cylinder when the suction cylinder and the exhausted parent reel come into contact.

11. Process according to claim 10, wherein the suction cylinder is placed in contact with the exhausted reel in a start-up phase of a cycle of removal of the residual paper from the exhausted parent reel and is moved away from the exhausted parent reel when said minimum diameter is reached.

12. Process according to claim 10, wherein said suction cylinder is provided with a longitudinal cavity on its outer surface, and a carriage is moved along a guide parallel to the axis of the suction cylinder and the carriage carries a blade adapted to be inserted in said longitudinal cavity.

13. Process according to claim 12, wherein the carriage is moved when the suction cylinder is not in contact with the exhausted parent reel.

14. Process according to claim 10, further comprising a step of locking the exhausted parent reel associated with said support unit.

15. Process according to claim 14, wherein the step of locking the exhausted parent reel associated with said support unit is a step of locking pins inserted in the exhausted parent reel.

* * * * *